US005090374A

United States Patent [19]

Itoh et al.

[11] Patent Number: 5,090,374

[45] Date of Patent: Feb. 25, 1992

[54] AUXILIARY STARTER APPARATUS FOR MULTI-CYLINDER DIESEL ENGINE BY USING 24-VOLT BATTERY CELL

[75] Inventors: Tsuneo Itoh; Kozo Nishiwaki, both of Nagoya, Japan

[73] Assignee: NGK Spark Plug Co., Ltd., Nagoya, Japan

[21] Appl. No.: 714,278

[22] Filed: Jun. 12, 1991

[51] Int. Cl.[5] ..... F02P 19/02

[52] U.S. Cl. ..... 123/179.6

[58] Field of Search ..... 123/179 BG, 179 H, 179 B, 123/145 A

[56] References Cited

U.S. PATENT DOCUMENTS

| | | | |
|---|---|---|---|
| 4,375,205 | 3/1983 | Green | 123/179 H |
| 4,512,297 | 4/1985 | Ichikawa et al. | 123/179 BG |
| 4,635,594 | 1/1987 | Ichikawa et al. | 123/179 BG |
| 4,762,982 | 8/1988 | Ohno et al. | 123/179 BG |

*Primary Examiner*—Andrew M. Dolinar

*Attorney, Agent, or Firm*—Cooper & Dunham

[57] ABSTRACT

In an auxiliary starter apparatus for four-cylinder diesel engine, each cylinder of which has a 12-volt glow plug adapted to be operated by a voltage of 12 volt, each of the four glow plugs has an electrical resistor. There is provided a first state in which each of the two electrical resistors connected in series is connected in parallel to form an electrically conductive path. A second state is provided in which the four electrical resistors are each connected in series to form an electrically conductive path. Electromagnetic relays are placed to alternatively select the first and second state. A 24-volt battery cell is provided, a voltage of which is impressed across the electrically conductive path of the first state by the first and second electromagnetic relay when starting the diesel engine, while the voltage of the 24-volt battery cell impressed across the electrically conductive path of the second state by the first and second electromagnetic relay once the diesel engine has started.

2 Claims, 4 Drawing Sheets

AUXILIARY STARTER APPARATUS FOR MULTI-CYLINDER DIESEL ENGINE BY USING 24-VOLT BATTERY CELL

BACKGROUND OF THE INVENTION

1. Field of the Invention

This invention relates to an auxiliary starter apparatus for multi-cylinder diesel engine in which glow plugs are operated by a 24-volt battery cell when starting the diesel engine.

2. Description of Prior Art

In an auxiliary starter apparatus for multi-cylinder diesel engine, each of the cylinders has a 12-volt glow plug which is adapted to be operated by a voltage of 12 volt. Electrical resistor wires from the corresponding glow plugs are connected in parallel to form an electrically conductive path. Across the conductive path, a voltage of a 12-volt battery cell is impressed to insure a predetermined quantity of heat within each cylinder of the diesel engine.

In recent years, it is suggested that a 24-volt battery cell may be used instead of the 12-volt battery cell to increase its capacity so as to cope with a multi-cylinder diesel engine, and quickly insuring a predetermined temperature rise within the corresponding cylinders of the multi-cylinder diesel engine.

In this instance, it is necessary to determine the resistor wire of the 24-volt glow plug four times greater than that of the 12-volt glow plug. Considering that an electrical resistance is inversely proportional to the square of its diameter, the resistor wire of the former is determined to be 0.1 mm in diameter since the resistor wire of the latter is 0.2 mm in diameter.

Therefore, the resistor wire of the 24-volt glow plug becomes thinner so that it is thought difficult for the thin resistor wire to work for a long period of service life, considering that the thin resistor wire is liable to be broken on account of repeated energization with the high voltage.

Therefore, it is an object of the invention to provide an auxiliary starter apparatus for multi-cylinder diesel engine which is capable of using 24-volt battery cell without thinning a resistor wire, and contributing to an extended period of service life with a relatively simple structure.

SUMMARY OF THE INVENTION

According to the invention, in an auxiliary starter apparatus for four-cylinder diesel engine, each cylinder of which has a 12-volt glow plug adapted to be operated by a voltage of 12 volt, the glow plug comprising a cylindrical metallic shell in which a bar-like heater is placed which has an electrical resistor embedded into a ceramic body, the auxiliary starter apparatus comprising: a first state in which each of the two electrical resistors connected in series is connected in parallel to form an electrically conductive path; a second state in which the four electrical resistors are each connected in series to form an electrically conductive path; first and second electromagnetic relay placed to alternatively select the first and second state; and a 24-volt battery cell, a voltage of which is impressed across the electrically conductive path of the first state by the first and second electromagnetic relay when starting the diesel engine, while the voltage of the 24-volt battery cell impressed across the electrically conductive path of the second state by the first and second electromagnetic relay once the diesel engine has started.

At the time of starting the diesel engine, a voltage of 12 volt is impressed across each resistor of the 12-volt glow plugs so as to quickly make them hot.

Once the diesel engine have started, a voltage of only 6 volt is impressed across each resistor of the 12-volt glow plugs, thus making it possible to carry out an after-glow operation.

Further, according to another invention, in an auxiliary starter apparatus for six-cylinder diesel engine, each cylinder of which has a 8-volt glow plug adapted to be operated by a voltage of 8 volt, the glow plug comprising a cylindrical metallic shell in which a bar-like heater is placed which has an electrical resistor embedded into a ceramic body, the auxiliary starter apparatus comprising: a first state in which each of the three electrical resistors connected in series is connected in parallel to form an electrically conductive path; a second state in which the six electrical resistors are each connected in series to form an electrically conductive path; first and second electromagnetic relay placed to alternatively select the first and second state; a 24-volt battery cell, a voltage of which is impressed across the electrically conductive path of the first state by the first and second electromagnetic relay when starting the diesel engine, while the voltage of the 24-volt battery cell impressed across the electrically conductive path of the second state by the first and second electromagnetic relay once the diesel engine has started.

At the time of starting the diesel engine, a voltage of 8 volt is impressed across each resistor of the 8-volt glow plugs so as to quickly make them hot.

Once the diesel engine have started, a voltage of only 4 volt is impressed across each resistor of the 8-volt glow plugs, thus making it possible to carry out an after-glow operation.

These and other objects and advantages of the invention will be apparent upon reference to the following specification, attendant claims and drawings.

DETAILED DESCRIPTION OF THE EMBODIMENTS

Figure 1:
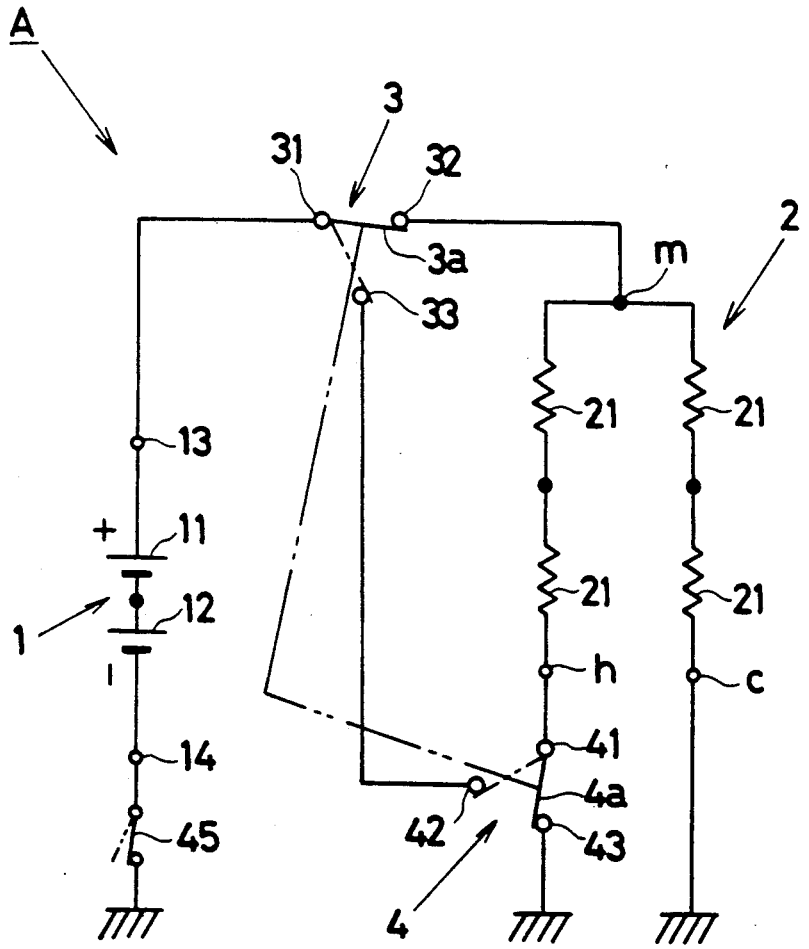
FIG. 1 is an electrical circuit according to a first embodiment of the invention.
Figure 2:
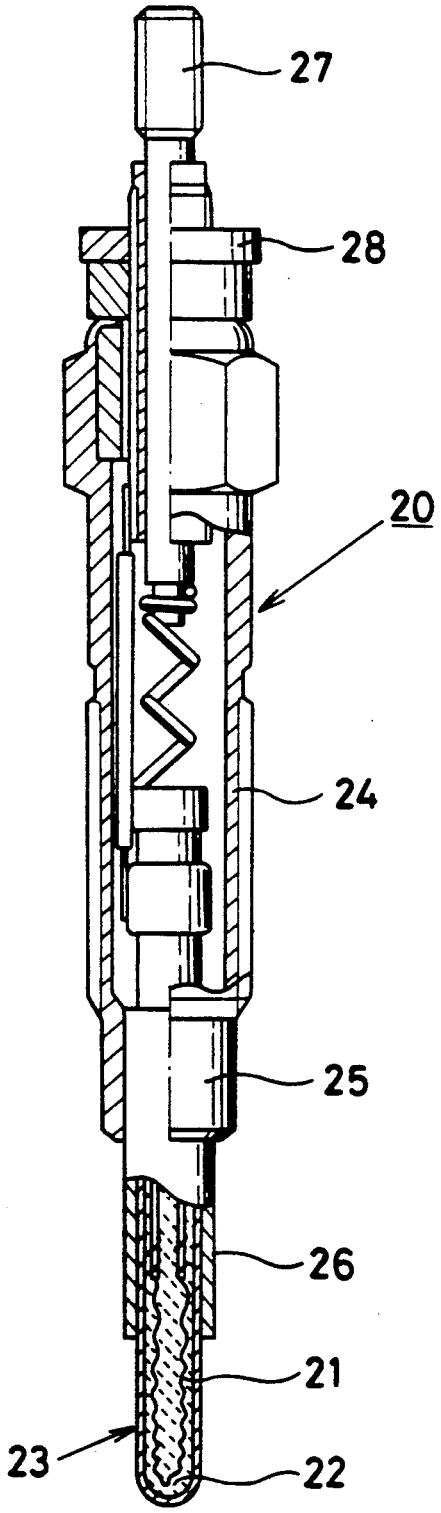
FIG. 2 is a plan view of a 12-volt glow plug, but partly longitudinally sectioned to show a ceramic heater in detail.

Referring to FIGS. 1, 2 which shows a first embodiment of the invention, denotation (A) designates an auxiliary starter apparatus for four-cylinder diesel engine by using a 24-volt battery cell 1 as a power source which is made by connecting two 12-volt battery cells 11, 12 in series as shown in FIG. 1. The auxiliary starter apparatus (A) further has a group 2 of four 12-volt glow plugs 20, each of which is adapted to be operated by a voltage of 12 volt, and has a cylindrical metallic shell 24 in which a bar-like ceramic heater 23 is concentrically placed as shown in FIG. 2. The ceramic heater 23 has a tungsten coil embedded into a silicon nitride body 22 to serve as a resistor wire 21 which measures approximately 0.2 mm in diameter. The ceramic heater 23, thus made, protracts its front end portion beyond a front end 25 of the metallic shell 24 through a sleeve 26. Within the metallic shell 24, two electrodes 27, 28 are placed in electrically insulating relationship with the metallic shell 24. The 12-volt glow plug 20 is adapted to keep a saturated temperature of the ceramic heater 23 within a range of 1000° C.±300° C. when 7 volt is impressed across the resistor wire 21.

Reverted to FIG. 1, the auxiliary starter apparatus (A) has a rapid-preheating relay 3 and an after-glow relay 4 which in turn serve as first and second relay according to the invention. The rapid-preheating relay 3 has a movable blade 3*a* and a fixed contact point 31 connected to a positive terminal 13 of the 24-volt battery cell 1, at the same time, having a movable contact point 32 connected to an electrically neutral point (m) of the resistor wires 21 of the group 2 of four 12-volt glow plugs 20.

On the other hand, the after-glow relay 4 has a movable blade 4*a* and a fixed contact point 41 connected to the neutral point (m) through a hot terminal (h) and the two resistor wires 21 each connected in series. The after-glow relay 4 further has a resetting contact point 42 connected to a resetting contact point 33 provided with the rapid-preheating relay 3. The after-glow relay 4 has a movable contact point 43 connected to a negative terminal 14 of the 24-volt battery cell 1 by way of an initial switch 45, and at the same time, connected to the neutral point (m) through a cold terminal (c) and other two resistor wires 21 each connected in series.

In this instance, the two resistor wires 21 connected in series are in a manner to be in parallel with the other two resistor wires 21 each connected in series.

With the structure thus far described, the initial switch 45 is closed upon starting the four-cylinder diesel engine by an operation of an ignition key of the diesel engine. In combination with the initial switch 45 closed, the rapid-preheating relay 3 is energized to make the movable blade 3*a* contact between the fixed contact point 31 and the movable contact point 32, while the after-glow relay 4 energized to make the movable blade 4*a* contact between the fixed contact point 41 and the movable contact point 43. A voltage of 12 volt is impressed across each of the two resistor wires 21 connected in series so as to generate a predetermined quantity of heat from the ceramic heater 23 so as to facilitate the starting of the four-cylinder diesel engine.

Once the engine has started, a timer (not shown) works to deenergize the rapid-preheating relay 3 to moves the movable blade 3*a* from solid-lined position to phantom-lined position so as to make it contact between the fixed contact point 31 and the resetting contact point 33. With the deenergization of the rapid-preheating relay 3, the after-glow relay 4 moves the movable blade 4*a* from solid-lined position to phantom-lined position so as to make it contact between the fixed contact point 41 and the resetting contact point 42.

In this situation, the voltage of the 24-volt of the battery cell 1 is impressed across the four resistor wires 21 which came to be arranged in series. This means that a voltage of only 6 volt is impressed across each of the four resistor wires 21 of the corresponding glow plugs 20 so as to carry out an after-glow operation.

Upon stopping the diesel engine, the initial switch 45 is open from solid-lined position to the phantom-lined position in combination with the operation of the ignition key of the diesel engine.

According to the invention, the following advantages are apparently obtained.

(i) The structure enables to employ the 12-volt glow plugs 20 to the four-cylinder diesel engine without thinning the resistor wires 21, thus contributing to an extended period of service life with a relatively simple construction.

(ii) As opposed to the case in which resistor wires alternately are energized by changing the connection of the battery cells 11, 12 from in series to in parallel, the structure obviates a risk of short circuit, instantaneous failure of power and inadvertent discharge of the battery cell as opposed to the case in which an electrical connection is switched from in parallel to in series.

(iii) The relays 3, 4 is such that the voltage is invariably impressed across each of the resistor wires 21 at the time of starting the diesel engine even when there is something wrong with the relays 3, 4 each contact point of which accidentally fails to change from the solid-lined position to the phantom-lined position in FIG. 1.

Figure 3:
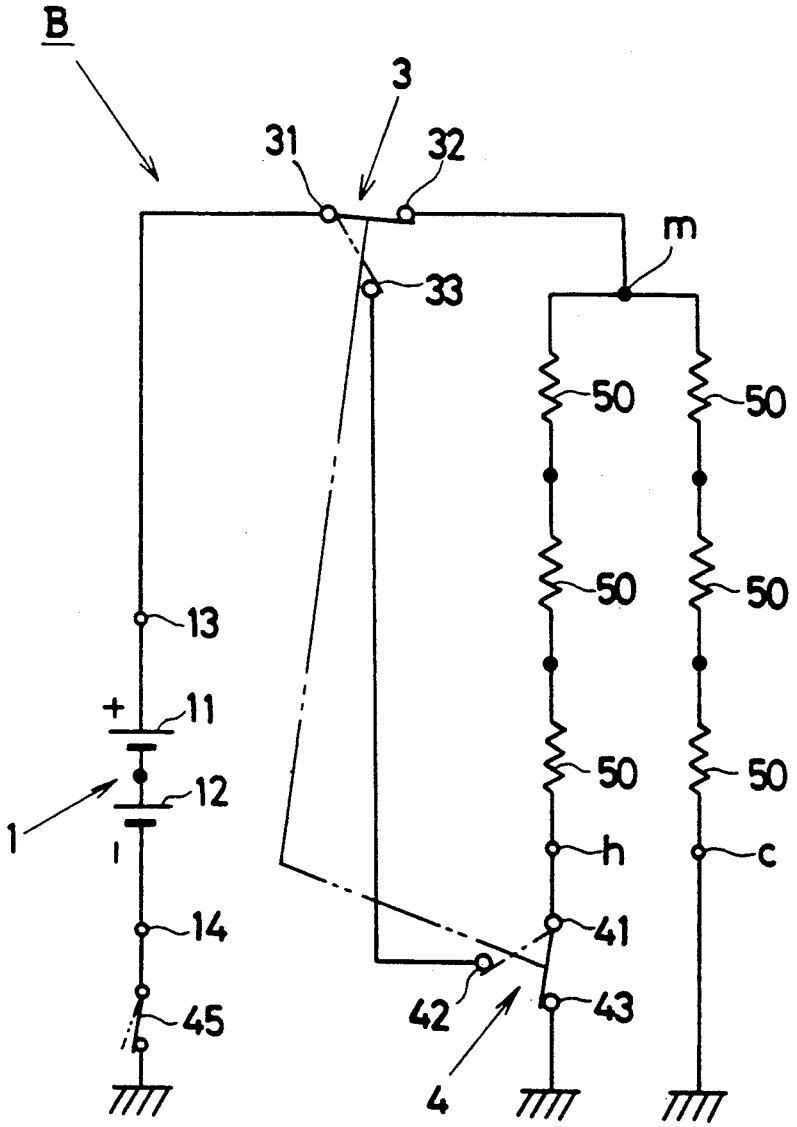
FIG. 3 is an electrical circuit according to a second embodiment of the invention.

FIG. 3 shows a second embodiment of the invention in which like reference numerals are identical to those in FIG. 1. Into an auxiliary starter apparatus (B) according to the second embodiment of the invention, are six 8-volt glow plugs accommodated, each of which is mounted on corresponding cylinder of the six-cylinder diesel engine. Each of the 8-volt glow plugs has a construction similar to that of the 12-volt glow plug 20 except that each of the 8-volt glow plug has a resistor wire 50 which measures approximately 0.25 mm in diameter.

In this second embodiment, the three resistor wires 50 each connected in series are in parallel with other three resistor wires 50 connected in series so as to impress 8-volt across each of the six resistor wires 50 when starting the six-cylinder diesel engine. Once the diesel engine has started, the relays 3, 4 changes an electrically conductive path to a manner in which the six resistor wires 50 are connected in series so as to impress 4 volt across each of the six resistor wires 50.

It is noted that an electrically conductive ceramic may be used instead of the resistor wire which is made of tungsten coil.

Figure 4:
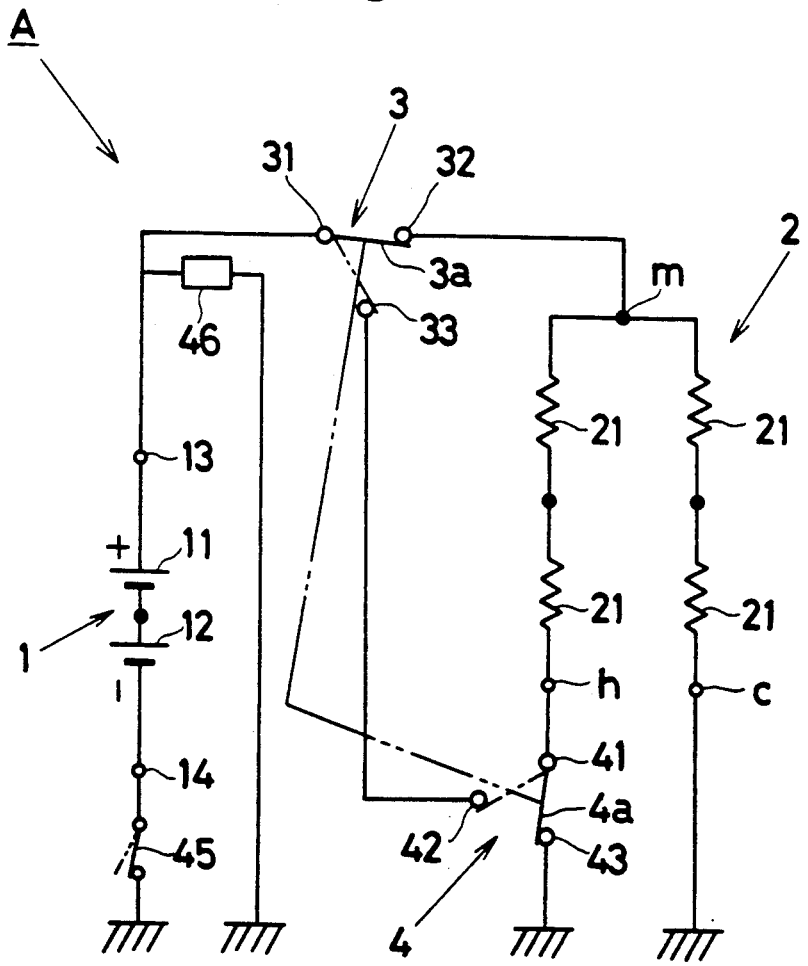
FIG. 4 is an electrical circuit according to a modified form of the first embodiment of the invention.

Further, it is also appreciated that on each cylinder of the diesel engine, a thermosensor 46 may be mounted which energizes the relays 3, 4 as shown in FIG. 4 when the thermosensor 46 detects a certain intensity of temperature within the cylinder.

While the invention has been described with reference to the specific embodiments, it is understood that this description is not to be construed in a limitting sense in as much as various modifications and additions to the specific embodiments may be made by skilled artisan without departing the spirit and scope of the invention.

What is claimed is:

1. In an auxiliary starter apparatus for four-cylinder diesel engine, each cylinder of which has a 12-volt glow plug adapted to be operated by a voltage of 12 volt, the glow plug comprising a cylindrical metallic shell in which a bar-like heater is placed which has an electrical resistor embedded into a ceramic body, the auxiliary starter apparatus comprising:

a first state in which two pairs of electrical resistors connected in series are connected in parallel to form an electrically conductive path;

a second state in which the four electrical resistors are connected in series to form an electrically conductive path;

first and second electromagnetic relay placed to alternatively select the first and second state; and a 24-volt battery cell, a voltage of which is impressed across the electrically conductive path of the first state by the first and second electromagnetic relay when starting the diesel engine, while the voltage of the 24-volt battery cell impressed across the electrically conductive path of the second state by the first and second electromagnetic relay once the diesel engine has started.

2. In an auxiliary starter apparatus for six-cylinder diesel engine, each cylinder of which has a 8-volt glow plug adapted to be operated by a voltage of 8 volt, the glow plug comprising a cylindrical metallic shell in which a bar-like heater is placed which has an electrical resistor embedded into a ceramic body, the auxiliary starter apparatus comprising:

a first state in which two groups of three electrical resistors connected in series are connected in parallel to form an electrically conductive path;

a second state in which the six electrical resistors are connected in series to form an electrically conductive path;

first and second electromagnetic relay placed to alternatively select the first and second state; and a 24-volt battery cell, a voltage of which is impressed across the electrically conductive path of the first state by the first and second electromagnetic relay when starting the diesel engine, while the voltage of the 24-volt battery cell impressed across the electrically conductive path of the second state by the first and second electromagnetic relay once the diesel engine has started.

* * * * *